US005634687A

United States Patent [19]

Gamble

[11] Patent Number: 5,634,687

[45] Date of Patent: Jun. 3, 1997

[54] CHILD'S STOOL

[76] Inventor: Carol D. Gamble, 9980 Canvasback Cir., Shreveport, La. 71108

[21] Appl. No.: 550,554

[22] Filed: Oct. 31, 1995

[51] Int. Cl.[6] ..... A47D 1/00

[52] U.S. Cl. ..... 297/338; 297/440.1; 297/440.23; 297/487

[58] Field of Search ..... 297/153, 256.15, 297/338, 440.1, 440.23, 487, 488; 108/159; 248/188.9; 312/111, 265.5, 265.6; 403/257, 258, 260

[56] References Cited

U.S. PATENT DOCUMENTS

| | | | |
|---|---|---|---|
| D. 138,620 | 8/1944 | Morley | D6/350 |
| D. 242,423 | 11/1976 | Culligan | D6/335 |
| D. 244,648 | 6/1977 | Swain | D6/335 |
| D. 248,516 | 7/1978 | Johansson | D6/335 |
| D. 314,674 | 2/1991 | Kohus et al. | D6/333 |
| D. 330,842 | 11/1992 | Meeker et al. | D6/333 |
| 763,306 | 6/1904 | Miller | 248/188.9 |
| 2,518,425 | 8/1950 | Kahn | 297/338 |
| 2,692,637 | 10/1954 | Rainwater | D6/336 |
| 3,103,385 | 9/1963 | Grieco | 297/467 |
| 3,575,465 | 4/1971 | Dolby et al. | D6/336 |
| 4,828,324 | 5/1989 | Putnam | 297/440.1 |
| 4,854,638 | 8/1989 | Marcus et al. | D6/335 |
| 4,889,388 | 12/1989 | Hime | 277/467 X |
| 4,896,778 | 1/1990 | Ferdinand et al. | 403/26 X |
| 5,087,097 | 2/1992 | Hehn | 297/153 |
| 5,368,380 | 11/1994 | Mottmiller et al. | 312/111 X |
| 5,478,145 | 12/1995 | Kamachi | 312/111 X |

FOREIGN PATENT DOCUMENTS

| | | | |
|---|---|---|---|
| 565306 | 10/1953 | Canada | 403/258 |
| 1148687 | 4/1969 | United Kingdom | 403/258 |
| 2006617 | 5/1979 | United Kingdom | 297/338 |

*Primary Examiner*—Peter R. Brown
*Attorney, Agent, or Firm*—Brady, O'Boyle & Gates

[57] ABSTRACT

A child's stool is provided with a vertically adjustable platform and steps for a child to climb onto the platform, and a pair of fabric wall portions extend between the side walls of the stool.

13 Claims, 3 Drawing Sheets

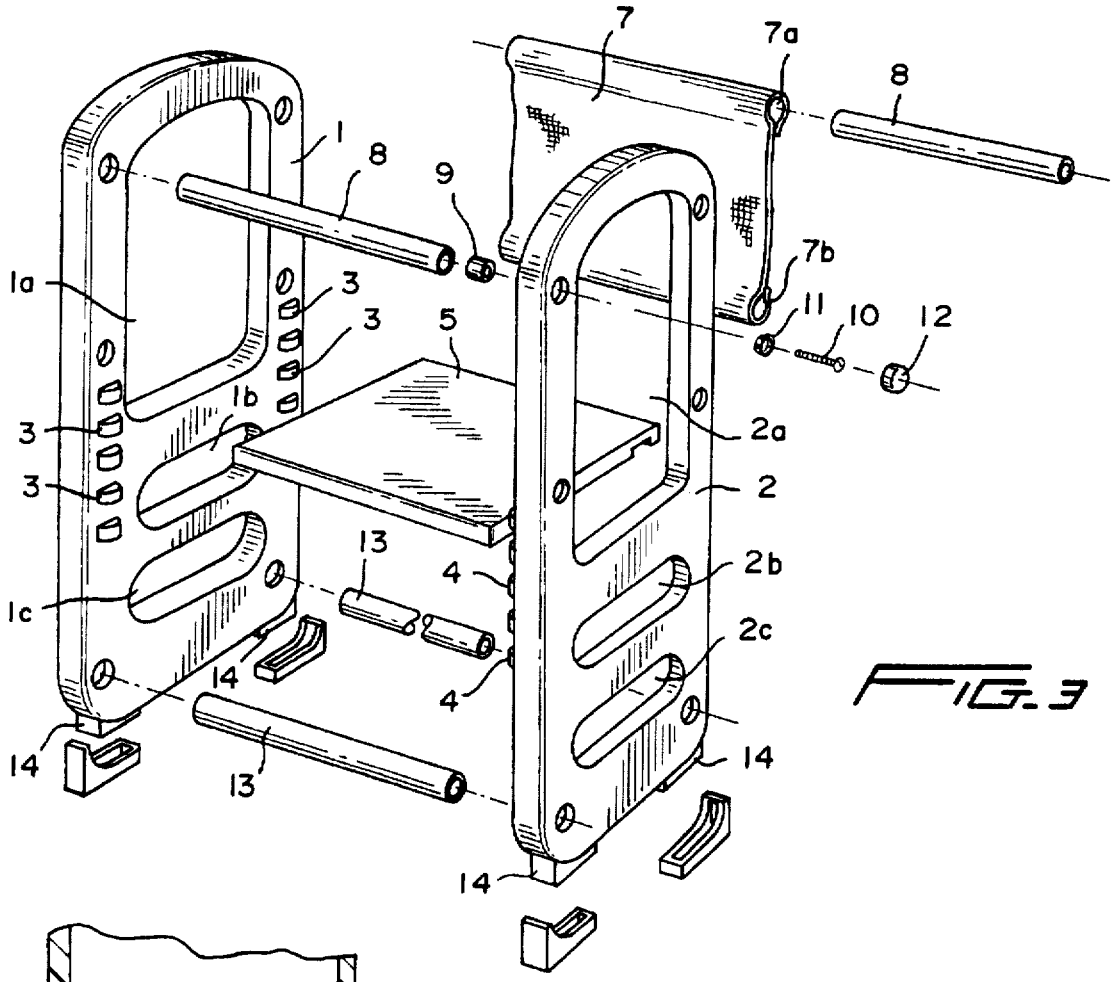
FIG. 3
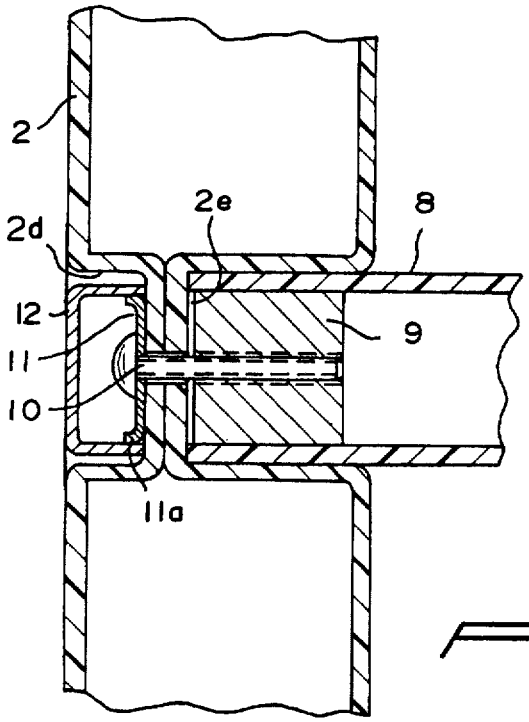
FIG. 4
FIG. 5
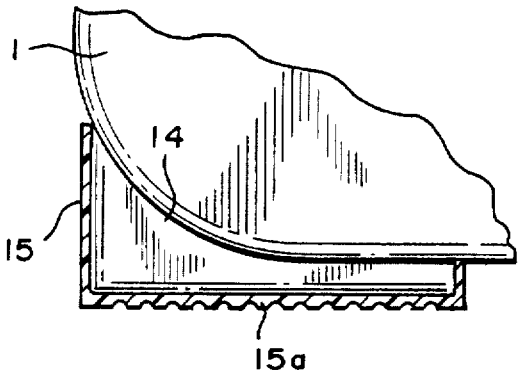

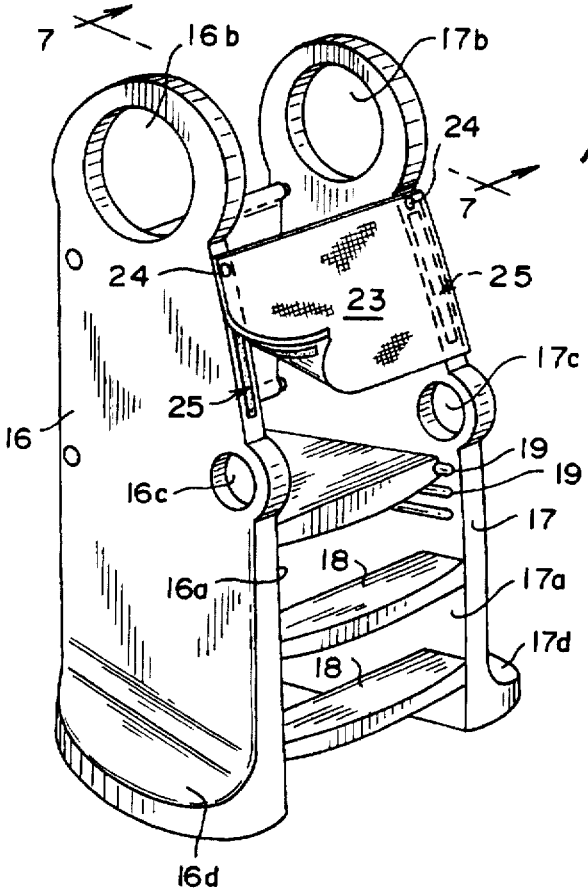
FIG. 6
FIG. 7
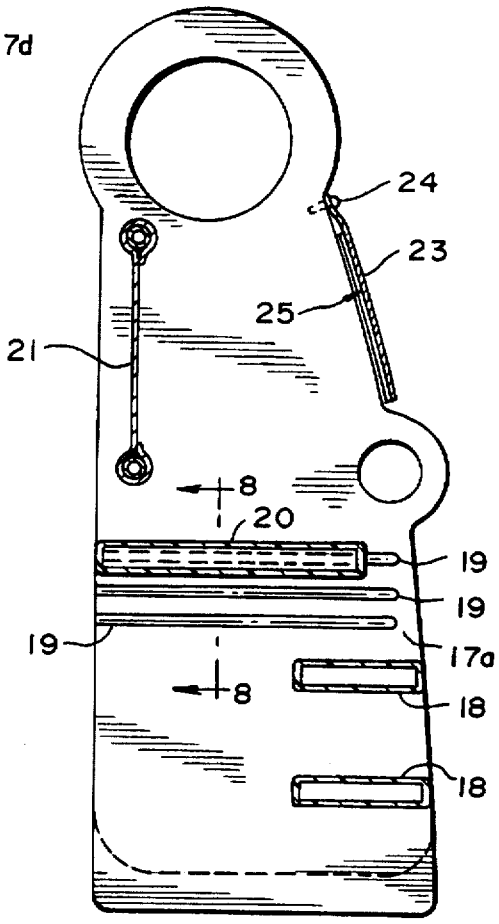
FIG. 8
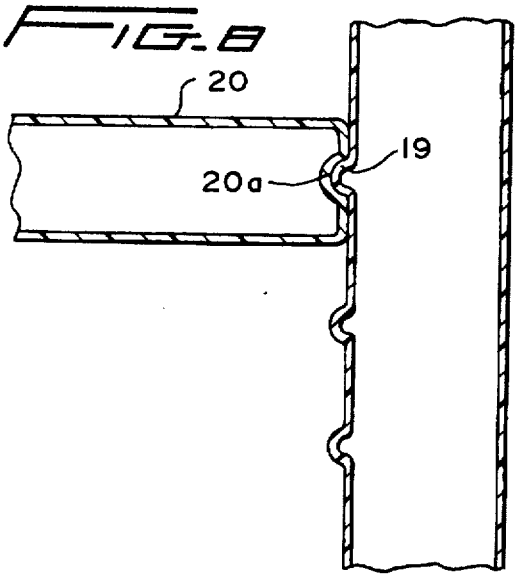

CHILD'S STOOL

BACKGROUND OF THE INVENTION

In Applicant's U.S. Pat. No. 5,421,636 dated Jun. 6, 1995, there is disclosed a multi-purpose child's furniture combining a child's stool and a high chair to not only help children extend their reach to elevated areas, such as sinks for washing their hands, but also for providing a seat to accommodate a child while being fed.

In Applicant's continued research and development on child's furniture, the climbing stool of the present invention has been devised which is relatively inexpensive to fabricate and easily assembled while providing an adjustability to accommodate children of different sizes.

SUMMARY OF THE INVENTION

The child's stool of the present invention comprises, essentially, a pair of horizontally-spaced, parallel, hollow, plastic, vertically extending side walls having a plurality of vertically-spaced, horizontally extending tongues integral with the inner surfaces of each side wall. A floor is mounted on a selected pair of oppositely extending tongues, whereby, the floor can be adjustably mounted to accommodate children of various sizes. Fabric panels extend between the upper end portions of the side walls at the front and rear thereof.

In one embodiment, the side walls are provided with openings to provide a ladder or foot holes so that a child can climb from the side of the stool onto the floor. In another embodiment, the front fabric panel is removably connected to the side walls and steps extend between and are integral with the side walls.

BRIEF DESCRIPTION O THE DRAWINGS

FIG. 3 is an exploded view of the stool shown in FIG. 1;

FIG. 4 is a view taken along line 4—4 of FIG. 1;

FIG. 5 is a fragmentary view partly in section showing one of the stool feet;

FIG. 6 is a perspective view of another embodiment of the child's

FIG. 7 is a view taken along line 7—7 of FIG. 6; and

FIG. 8 is a view taken along line 8—8 of FIG. 7.

DESCRIPTION OF THE PREFERRED EMBODIMENTS

Figure 1:
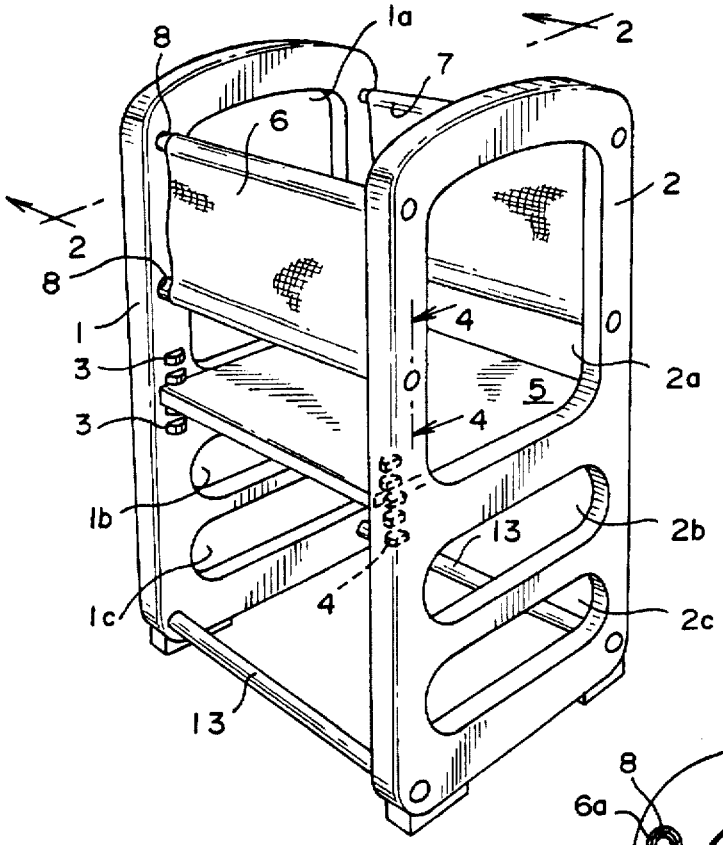
FIG. 1 is a perspective view of one embodiment of the child's stool.
Figure 2:
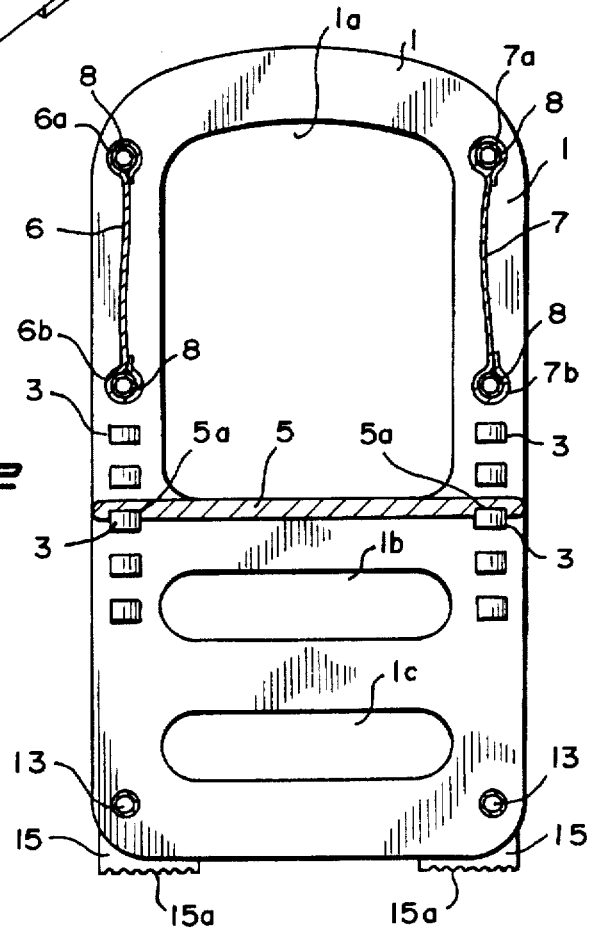
FIG. 2 is a view taken along line 2—2 of FIG. 1.

Referring to the drawings and, more particularly, to FIGS. 1, 2, and 3, one embodiment of the child's stool of the present invention comprises a pair of horizontally-spaced, parallel, hollow, plastic, vertically extending side walls or panels 1 and 2 having a plurality of vertically-spaced, horizontally extending tongues 3 and 4 integral with the inwardly-facing surfaces of each side wall 1 and 2 at the front and rear thereof. A platform or floor 5 having a recess 5*a* at each corner on the bottom surface thereof is mounted on a selected pair of aligned, oppositely-extending tongues 3 and 4, wherein the tongues are received in the respective recesses 5*a*, to thereby prevent the floor 5 from sliding, whereby the floor can be adjustably mounted to accommodate children of various sizes whether standing or sitting on the platform.

Openings 1*a*, 1*b*, 1*c*, and 2*a*, 2*b*, 2*c* are provided in the respective side walls 1 and 2 to provide ladders or foot holes so that a child can climb onto the floor 5 from the side of the stool.

A pair of fabric panels 6 and 7 extend between the upper end portions of the side walls 1 and 2 above the floor 5. Each fabric panel is held in place by a tube 8 extending through looped edges 6*a*, 6*b*, and fastened at each end to the side walls 1 and 2.

The details of the fastening of the tubes 8 to the side walls 1 and 2 are illustrated in FIG. 4 wherein it will be seen that the walls of the side wall 2 are necked inwardly to provide abutting surfaces forming an outwardly-facing recess 2*d* and an inwardly-facing recess 2*e*. The end of the tube, containing a plug 9, is inserted into the recess 2*e*, and a threaded bolt or screw 10 and washer 11 are inserted into the recess 2*d* with the bolt 10 extending through the abutting surfaces of the recesses 2*d* and 2*e*, and with the plug 9. A decorative cap 12 is inserted into the recess 2*d* to cover the bolt head, the cap 12 being frictionally held in the recess by the outer peripheral edge 11*a* of the washer.

The lower portions of the side walls 1 and 2 are similarly held in spaced-apart relationship by transversely extending tubes 13.

As will be seen in FIGS. 3 and 5, the bottom edge portions of each side wall 1 and 2 are provided with integral feet 14. To provide the feet with a friction surface against the supporting ground, each foot 14 has a cap 15, provided with a corrugated bottom surface 15*a*, snapped thereon.

It will be readily apparent that the embodiment of the invention shown in FIGS. 1 to 5 can be easily assembled by fastening the tubes 8 and associated fabric panels 6 and 7 to the side walls 1 and 2, together with the tubes 13, using the fastening assembly shown in FIG. 4. The platform 5 is then inserted to rest on the tongues 3 and 4, and the foot caps 15 are snapped onto the feet 14 to complete the assembly of the stool.

Conversely, the stool of the present invention can be readily disassembled for storage, for instance, after the child has outgrown the stool, by removing the floor 5, the decorative caps 14 and bolts 10 from each end of the tubes 8 and 13, and the fabric panels 7 and 8 from the tubes 8. The various components can then be placed in a suitable storage container.

FIGS. 6 to 8 illustrate another embodiment of the invention wherein a pair of hollow, plastic, vertically-extending side panels 16 and 17 are held in spaced parallel relationship by transversely-extending step member 18 integral with the inwardly extending faces 16*a* and 17*a* of the side panels 16 and 17. Integral tongues 19 are formed on the inwardly-extending faces 16*a* and 17*a* of the side panels. The tongues 19 extend from the front of the stool to the rear and provide tracks for a hollow, plastic platform 20 having a groove 20*a* on each lateral edge thereof which receive the tongues 18 whereby the platform 20 is slidably mounted on a selected pin of aligned tongues 19 whereby the platform 20 can be adjustably mounted to accommodate children of various sizes.

The rear of the stool is provided with a fabric panel 21 which is secured to the side panels 16 and 17 by transversely-extending tubes 22 in the same manner as described above in connection with the embodiment of FIGS. 1 to 5; however, a front fabric panel 23 is removably connected to the side panels 16 and 17 by suitable snap fasteners 24 and a hook and loop fastener 25, such as Velcro®.

To complete the structure of the embodiment of FIGS. 6 to 8, openings 16*b*, 16*c*, and 17*b*, 17*c* are formed in the side panels 16 and 17 to form handles for the child when climbing the stool, and the lower ends of each panel are formed with integral outwardly-extending portions 16*d* and 17*d* to form stabilizing feet for the stool.

It is to be understood that the forms of the invention herewith shown and described are to be taken as preferred examples of the same, and that various changes in the shape, size, and arrangement of parts may be resorted to, without departing from, the spirit of the invention or scope of the subjoined claims.

I claim:

1. A child's stool, comprising a pair of spaced, parallel, vertically extending side panels, said side panels having inner oppositely extending faces, at least one transversely extending fabric panel positioned at the upper end portions of said side panels between said inner oppositely extending faces to thereby form a wall portion, a pair of loops on opposite transversely extending edge portions of said fabric panel, a transversely extending tube extending through each of said loops, a plug contained in each of said tubes, recesses provided in opposite sides of each side panel, opposite ends of said tubes being interested into said recesses on one side of said panels, a threaded fastener assembly being inserted through the recesses on the other side of said panels and into said plug, whereby the tubes are fastened to the side panels, a decorative cap inserted into the recesses on the other side of said panels to cover each fastener assembly, a plurality of vertically spaced, horizontally extending faces of said side panels, and a transversely extending platform mounted on a selected pair of aligned tongues, whereby the position of the platform relative to the ground can be adjusted to accommodate children of various sizes.

2. A child's stool, according to claim 1, wherein the side panels are provided with steps, whereby a child can climb onto the platform.

3. A child's stool, according to claim 2, wherein the steps comprise a plurality of openings in the side panels providing foot holes, whereby a child can climb through the side of the stool onto the platform.

4. A child's stool, according to claim 2, wherein a steps comprise transversely extending step members integral with the inner oppositely-extending faces of the side panels.

5. A child's stool, according to claim 4, wherein openings are provided in the side panels to provide handles for a child while climbing the stool steps.

6. A child's stool, according to claim 4, wherein the lower end portions of each panel is provided with integral outwardly extending portions forming stabilizing feet for the stool.

7. A child's stool, according to claim 1, wherein feet are integral with the lower edge portion of each side panel, and a cap having a corrugated lower surface, snapped onto each foot, to thereby provide a friction surface for supporting the stool on the ground.

8. A child's stool, according to claim 1, wherein a pair of transversely extending tubes are secured to the oppositely-extending inner faces of the side panels in proximity to the lower edge portions thereof.

9. A child's stool according to claim 8, wherein the decorative cap, threaded fastener assembly, transversely extending tubes, and fabric panel are detachably connected to their respective components, whereby the child's stool can be disassembled for storage.

10. A child's stool, according to claim 1, wherein a pair of transversely-extending fabric panels extend between the side panels, to thereby form wall portions at the front and rear of the stool.

11. A child's stool, according to claim 10, and means for detachably connecting the fabric panel forming the front wall portion to said side panels.

12. A child's stool, according to claim 11, wherein the means for detachably connecting the fabric panel to the side panels comprises snap fasteners, and loop and hook fasteners.

13. A child's stool according to claim 1, wherein a plurality of recesses are provided in the bottom surface of the platform, each recess adapted to receive a respective tongue, to thereby prevent the platform from sliding relative to the side panels while in an adjusted position.

* * * * *

UNITED STATES PATENT AND TRADEMARK OFFICE
CERTIFICATE OF CORRECTION

PATENT NO. : 5,634,687
DATED : June 3, 1997
INVENTOR(S) : Carol D. Gamble

It is certified that error appears in the above-identified patent and that said Letters Patent is hereby corrected as shown below:

Column 3, line 20, change "interested" to -inserted-;

Column 3, line 26, after "extending" insert -tongues integral with the inner oppositely extending-.

Signed and Sealed this
Twelfth Day of August, 1997

Bruce Lehman

*Attest:*

BRUCE LEHMAN

*Attesting Officer*

*Commissioner of Patents and Trademarks*